US005810346A

United States Patent [19]

Jörg

[11] Patent Number: 5,810,346

[45] Date of Patent: Sep. 22, 1998

[54] PAPER HANDLING SYSTEM

[75] Inventor: Helmut Jörg, Neusäss, Germany

[73] Assignee: Böwe Systec AG, Germany

[21] Appl. No.: 619,547

[22] PCT Filed: Jul. 21, 1995

[86] PCT No.: PCT/EP95/02890

§ 371 Date: Aug. 5, 1996

§ 102(e) Date: Aug. 5, 1996

[87] PCT Pub. No.: WO96/04195

PCT Pub. Date: Feb. 15, 1996

[30] Foreign Application Priority Data

Aug. 5, 1994 [DE] Germany ..... 44 27 813.6

[51] Int. Cl.[6] ..... B65H 43/00

[52] U.S. Cl. ..... 270/59; 270/58.3; 270/58.07; 271/9.01; 271/9.12; 271/9.13; 271/225; 414/791.1; 198/370.1; 198/349.9

[58] Field of Search ..... 198/370.1, 349.9, 198/349.8, 418.3; 270/46, 59, 58.02, 58.18, 58.2, 58.21, 58.22, 58.23; 414/790.3, 791.1; 271/9.01, 9.12, 9.13

[56] References Cited

U.S. PATENT DOCUMENTS

| | | | |
|---|---|---|---|
| 4,568,072 | 2/1986 | Piotroski | 270/58 |
| 4,989,852 | 2/1991 | Gunther | 270/58.02 |
| 5,462,399 | 10/1995 | Clupper et al. | 414/790.3 |
| 5,575,465 | 11/1996 | Auerbach et al. | 271/9.13 |

FOREIGN PATENT DOCUMENTS

| | | | |
|---|---|---|---|
| 359043750 | 3/1984 | Japan | 271/9.13 |
| 401288540 | 11/1989 | Japan | 271/9.01 |
| 402169431 | 6/1990 | Japan | 271/9.01 |
| 2 084 966 | 4/1982 | United Kingdom | B65H 39/02 |
| WO94/20400 | 2/1994 | WIPO | B65H 39/02 |

*Primary Examiner*—H. Grant Skaggs
*Attorney, Agent, or Firm*—Beyer & Weaver, LLP

[57] ABSTRACT

A paper handling system including a gathering path and a plurality of paper handling units. The (114 to 138), said gathering path is defined by a plurality of essentially corresponding modules (102, 200), each of said modules (102, 200) being provided with a collect box (104, 210), a transfer bridge (212) for effecting supply in the direction of transport (106, 202), at least one transfer bridge (214, 216) for effecting supply in a direction transversely to the direction of transport, and a discharge unit (300).

19 Claims, 4 Drawing Sheets

PAPER HANDLING SYSTEM

FIELD OF THE INVENTION

The present invention refers to a paper handling system and, in particular, to a gathering path used in such a paper handling system.

BACKGROUND OF THE INVENTION

Paper handling systems are predominantly used by large enterprises, banks, insurance companies, service-rendering enterprises, etc. In these enterprises, the paper handling systems are used for processing large amounts of paper, such as bills, reminders, statements of account, insurance policies or cheques.

In order to obtain, e.g. in the case of insurance policies, an adequate collocation of the various necessary pieces of paper at the end of the paper handling system, it is necessary that the paper handling system correctly processes the various pieces of paper when they have been printed. This processing is carried out at successive stations of the paper handling system and comprises e.g. the steps of separating, folding, sorting, collecting and stitching the various pieces of paper as well as, subsequently, the steps of enveloping the collocated insurance policy and putting a stamp on the letter so that letters ready for dispatch are discharged at the output of the paper handling system.

In view of the fact that the above-mentioned various processing operations are carried out at successive stations in the paper handling system, it is necessary to provide a connection between these individual stations. This connection is established by a so-called gathering path by means of which the individual stations of the paper handling system are interconnected.

Each of the known gathering paths essentially consists of a single constructional unit, which must be produced in dependance upon the requirements which have to be fulfilled by the paper handling system.

This kind of gathering path entails substantial disadvantages, said disadvantages being primarily caused by the fact that it is necessary to produce the gathering path in dependence upon requirements made by specific customers, i.e. it must be "made to measure". These requirements made by specific customers comprise the kind of paper processing as well as the space available at the customer's firm for erecting such a paper handling system. Even if the processing requirements are essentially identical on the part of the customer, the paper handling system and especially the gathering path must, in the case of different spatial circumstances, still be made to measure to meet the respective spatial circumstances.

This lack of adaptability in the production of a paper handling system results in a complicated production of the gathering path and, consequently, in an unacceptably long time of delivery of the whole system.

An additional disadvantage of this known gathering path is to be seen in the fact that in cases in which the processed pieces of paper have to be enveloped differently, i.e. put into different envelopes, branching of the gathering path is required. In known gathering paths, such branching necessitates a substantial technological expenditure, which makes the production process of the gathering path even more complicated and which, consequently, extends the time of delivery even further.

Wo 94/20400 already discloses a machine for processing printed matter comprising a plurality of individual stations for producing partial products, which are supplied to a gathering path via associated supply belts; on said gathering path, the individual partial products are combined into a final product, e.g. in the form of a book block. Technical details concerning the structural design of this gathering path cannot be inferred from this publication. GB 2084966 A discloses a system for collocating sheets, which originate from different stacks, during their periodic conveyance along a plurality of conveyor means. These conveyor means combine respective groups of sheets or groups of sheets and envelopes and supply these groups to a common conveyor in an overlapping stream of material. The plurality of conveyors as well as the common conveyor have the form of gathering paths which are specially adapted to the intended use.

SUMMARY OF THE INVENTION

The present invention provides a paper handling system which is less complicated to arrange or install and which permits a simple connection of the various processing stations.

In one embodiment a paper handling system according to the invention includes

- a modular gathering path; and
- a plurality of paper handling units,
- said gathering path comprising a plurality of essentially corresponding modules; wherein each of said modules comprises:
  - a collector box;
  - a transfer bridge for effecting supply in the direction of transport;
  - at least one transfer bridge for effecting supply in a direction transversely to the direction of transport; and
  - a discharge unit.

BRIEF DESCRIPTION OF THE DRAWINGS

In the following, a preferred embodiment of the present invention will be described in detail making reference to the drawings enclosed, in which.

DETAILED DESCRIPTION OF PREFERRED EMBODIMENTS OF THE INVENTION

Figure 1:
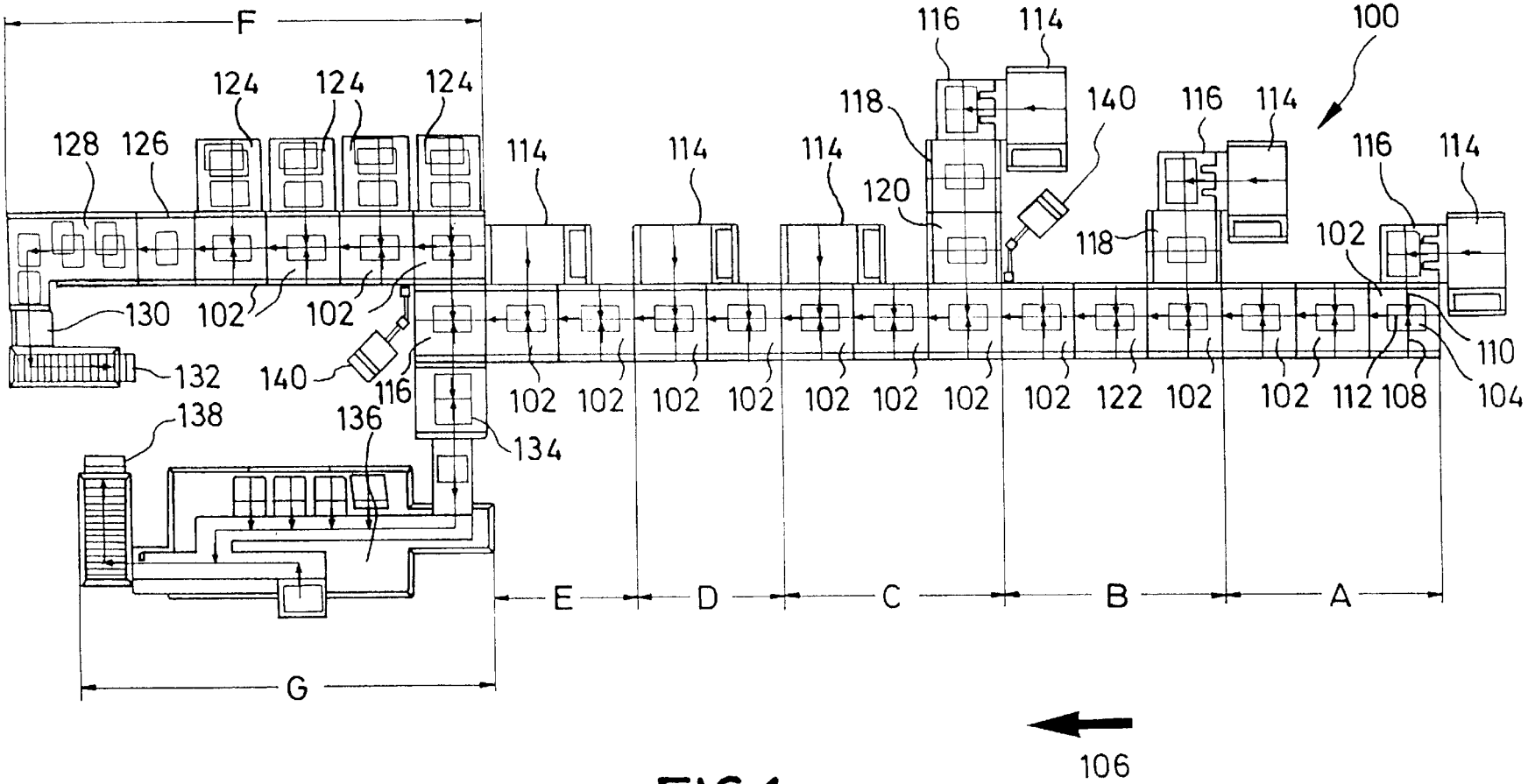
FIG. 1 shows an embodiment of a paper handling system according to the present invention.

A preferred embodiment of the paper handling system according to the present invention is now described on the basis of FIG. 1. The paper handling system 100 comprises a gathering path including a plurality of modules 102 which correspond to one another.

The modules 102 each comprise a collector box 104, a transfer bridge for supplying paper in a direction of transport, indicated by arrow 106 in FIG. 1, at least one transfer bridge for effecting a supply transversely to the direction of transport, as indicated by arrows 108, 110, and a discharge unit designated by reference numeral 112. A detailed description of the modules will follow hereinbelow on the basis of FIGS. 2 and 3.

The paper handling system 100 according to the present invention additionally comprises a plurality of paper handling units 114–138. Furthermore, the paper handling system 100 comprises two monitors 140 for supervising the sequence of operating steps.

In the following, the operation of the paper handling system according to the present invention will be described in detail.

A plurality of cutters 114 cuts paper, which has already been printed and which is supplied to these cutters e.g. in the form of paper rolls, to a predetermined size. It is obvious that the various cutters 114 supply different printed pieces of paper.

In order to simplify the description, the paper handling system was subdivided into sections A to G and said paper handling system is now described on the basis of the individual sections.

In section A processing of the paper to be handled is started. The cutter 114 makes two pieces of printed paper available to a rerouting module 116, said two pieces of printed paper being then supplied by said rerouting module 116 to a first module 102 of the gathering path in a direction transversely to the direction of transport 106. By way of two additional modules 102, the pieces of paper supplied are transferred to section B.

In section B, additional pieces of paper are supplied to the pieces of paper contained in the first module. This supply is again effected via a cutter 114 supplying two pieces of paper to a rerouting module 116, said pieces of paper being transferred to module 102 via a transfer module 118. Subsequently, the pieces of paper contained in said module are supplied to a stitcher 122, which stitches said pieces of paper and supplies them via a further module to section C. Furthermore, it is possible to collect in said further module pieces of paper so as to form subgroups.

In section C, additional pieces of paper are supplied to an imbrication means 120 via a cutter 114, a rerouting module 116 and a transfer module 118, said imbrication means 120 arranging the supplied pieces of paper such that one is placed below the other in overlapping relationship therewith, i.e. it deposits said pieces of paper such that a suitable sequence of sheets is obtained. From said imbrication means 120, the imbricate pieces of paper are supplied to module 102. At this point, a monitor 140 for supervising the sequence of operating steps is provided. At the end of section C, the pieces of paper contained in the module have added thereto a further piece of paper supplied by a further cutter 114, and the pieces of paper are transferred to section D.

In section D, an additional piece of paper is again supplied to the pieces of paper contained in the module, said supply being effected by means of a further cutter 114. Following this, the pieces of paper are transferred to section E, which supplies to the pieces of paper contained in the module an additional piece of paper via a further cutter 114.

After section E, the pieces of paper are passed on to a rerouting module 116, which, depending on a control, passes the pieces of paper on either to section F or to section G. This is supervised by an additional monitor 140.

In section F, the pieces of paper in the four successive modules 102 have supplied thereto further individual sheets via four individual sheet supply means 124. Subsequently, the pieces of paper contained in the modules are supplied to a transfer module 126, and from said transfer module 126 to an enveloping unit 128, which will insert the prepared pieces of paper into envelopes DIN long or size C5. Following this, the envelopes are conveyed via a controlled-output box 130 to an imbrication belt 132 where they are collected.

If the rerouting module directs the prepared pieces of paper to section G, these pieces of paper will first be turned over by a turnover device 134 whereupon they will be supplied to an enveloping unit 136, which will insert the pieces of paper into size C4 envelopes and convey them, subsequently, to an imbrication belt 138.

The number of individual modules provided between the various sections depends on the spatial circumstances in which the paper handling system is arranged. It is, for example, necessary to provide between the individual paper handling units a sufficient amount of space for charging e.g. the cutters 114 with new material. In view of the fact that this material normally consists of very large rolls of paper, it is necessary to provide a sufficient amount of space for permitting these rolls of paper to be supplied e.g. with a fork-lift truck.

The direction of transport used in this embodiment corresponds to the portrait orientation. The supply of paper onto the gathering path takes place in the landscape orientation. By means of control processes, the paper to be supplied from the side can either be deposited on paper which is already contained in the module or it can be placed below this paper.

In order to control the total operating sequence of the paper handling system in FIG. 1, a central computing unit 140 is provided, which is connected to each of the modules of the gathering path and to each of the paper handling units. This computing unit supervises e.g. the number of finished letters, detects conditions of malfunction, such as e.g. mixing errors, and controls the elimination of such malfunction.

After having described the operating sequence of the paper handling system according to the present invention on the basis of FIG. 1, the structural design of a module of the gathering path will now be described in detail on the basis of FIGS. 2 and 3.

Figure 2:
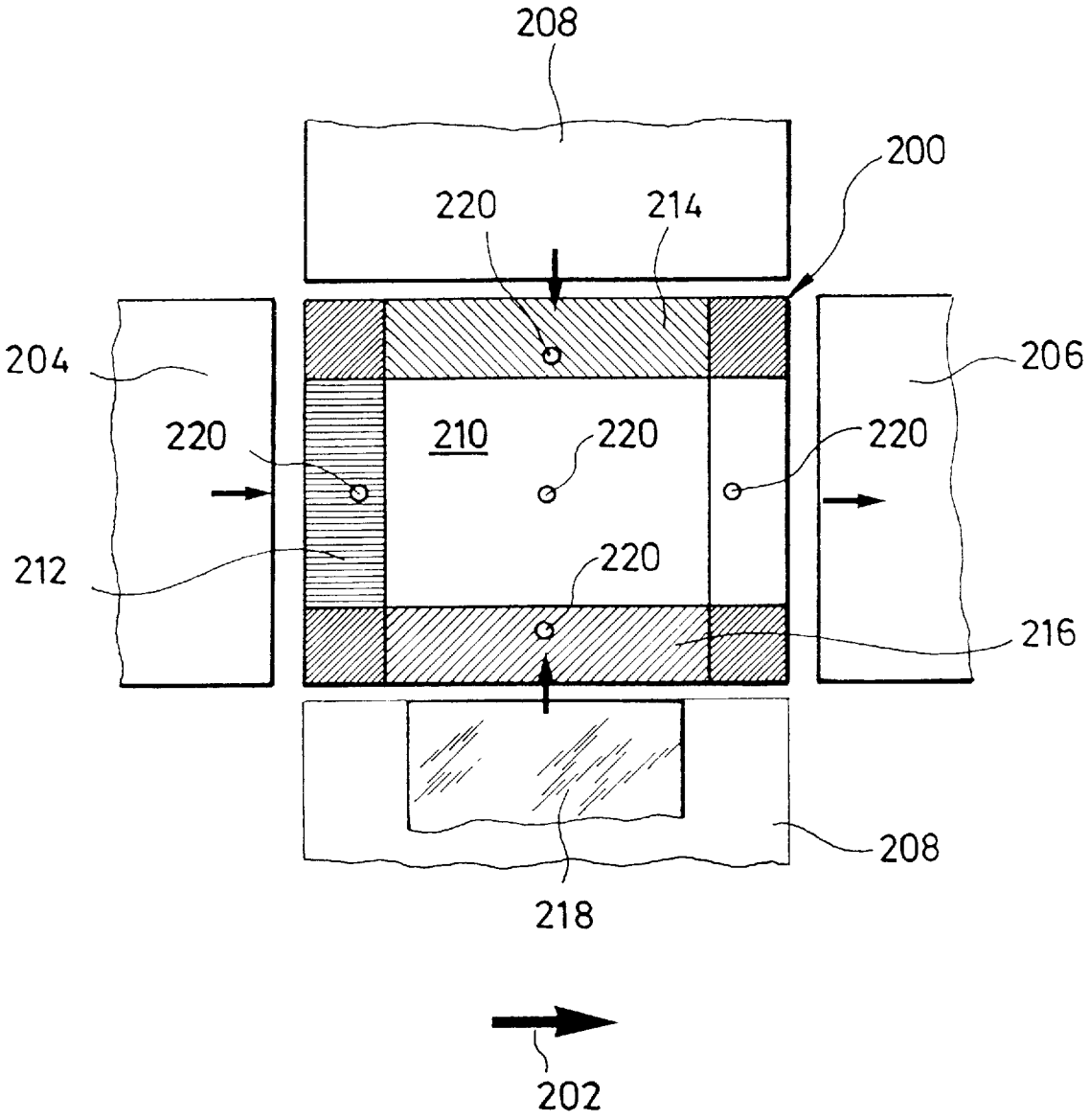
FIG. 2 shows a detailed top view of one of the modules used in FIG. 1.

FIG. 2 is a top view of one of the modules 102 used in FIG. 1. The module is designated by reference numeral 200 in FIG. 2. Arrow 202 shows the direction of transport, which, in the present case, is from the left to the right. A schematic representation of a preceding module 204 is shown ahead of module 200 when seen in the direction of transport, and a schematic representation of a subsequent module 206 is shown after module 200 when seen in the direction of transport. Transversely to the direction of transport, two paper handling units for supplying pieces of paper are shown, again in the form of schematic representations. This described arrangement of additional units and modules positioned around module 200 is described as an example. To persons skilled in the art it will be obvious that other arrangements may be provided.

The module 200 comprises a collector box 210, a transfer bridge 212 for supplying paper in the direction of transport, and a first as well as a second transfer bridge 214, 216 for supplying paper transversely to the direction of transport. A discharge unit will be described in detail hereinbelow on the basis of FIG. 3.

A piece of paper 218 is supplied to the collector box 210 e.g. transversely to the direction of transport via the second transfer bridge 216.

It is obvious that the first transfer bridge 214 and the transfer bridge 212 for effecting supply in the direction of transport supply the paper to the box 210 in a similar manner.

The module 200 is additionally provided with a plurality of sensors 220. The transfer bridge 212, the first and second transfer bridges 214, 216, the collector box 210 and the discharge unit each having associated therewith a sensor consisting of a light barrier in this preferred embodiment.

Figure 3:
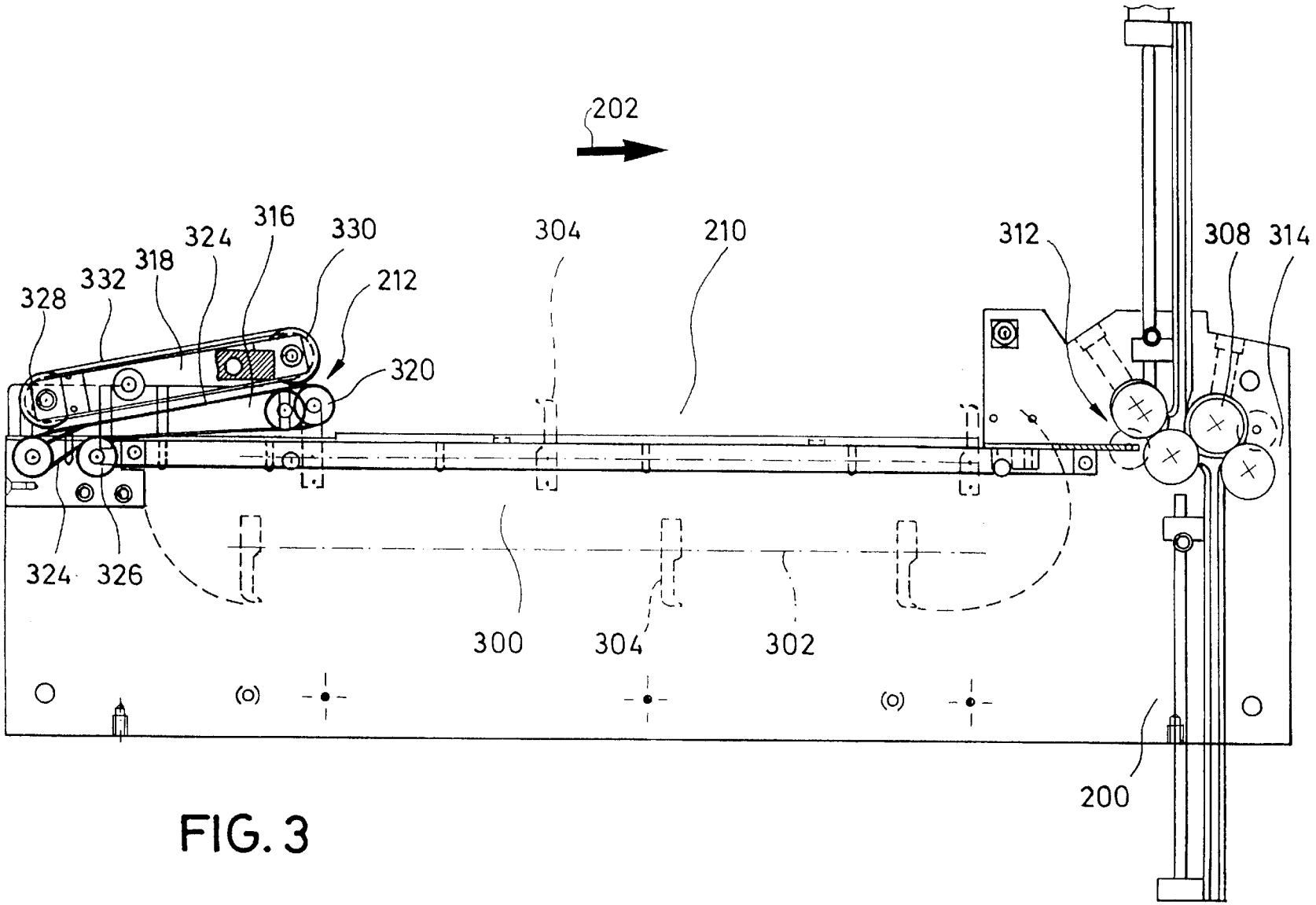
FIG. 3 shows a cross-sectional representation of the module shown in FIG. 2, in the direction of transport.

FIG. 3 shows a cross-sectional representation of the module 200, which is shown in FIG. 2, in the direction of transport, and identical reference numerals have been used to designate identical elements.

The transfer bridge 212 consists of a lower part 316 and an upper part 318.

The lower part 316 comprises two drive and guide pulleys 320, 322, which guide and drive four individual belts 324 consisting here of flat belts. For additionally guiding the belts, a deflection pulley 326 is provided.

The upper part 318 of the transfer bridge 212 is passive, i.e. it is not driven, but it is caused to rotate together with the driven lower part 316. This part 318 comprises two pulleys 328, 330 for guiding a round-section belt 332. The paper is guided between the lower part 316 and the upper part 318.

For use with different paper sizes, the lower part 316 of the transfer bridge 212 can be displaced; this is made clear by the two pulleys shown near 320.

The module 200 additionally comprises a discharge unit 300 comprising a circulating chain 302 with a plurality of fingers 304, said fingers 304 extending at right angles to the lower surface of the collector box 210 and being provided for pushing the paper out of said collector box 210 while the chain 302 is rotating.

The fingers serve simultaneously as stoppers for the paper supply in the discharge direction. A software control guarantees correct positioning of the fingers.

On the output side, the module 200 is provided with a paper folder 308, which is adapted to be adjusted for producing a Z-fold, a wound fold, a single fold or no fold at all. In the present embodiment, the structural design of the paper folder 308 is of such a nature that the input level 312 and the output level 314 are identical. As for the rest, the paper folder has a structural design which is known per se.

Figure 4:
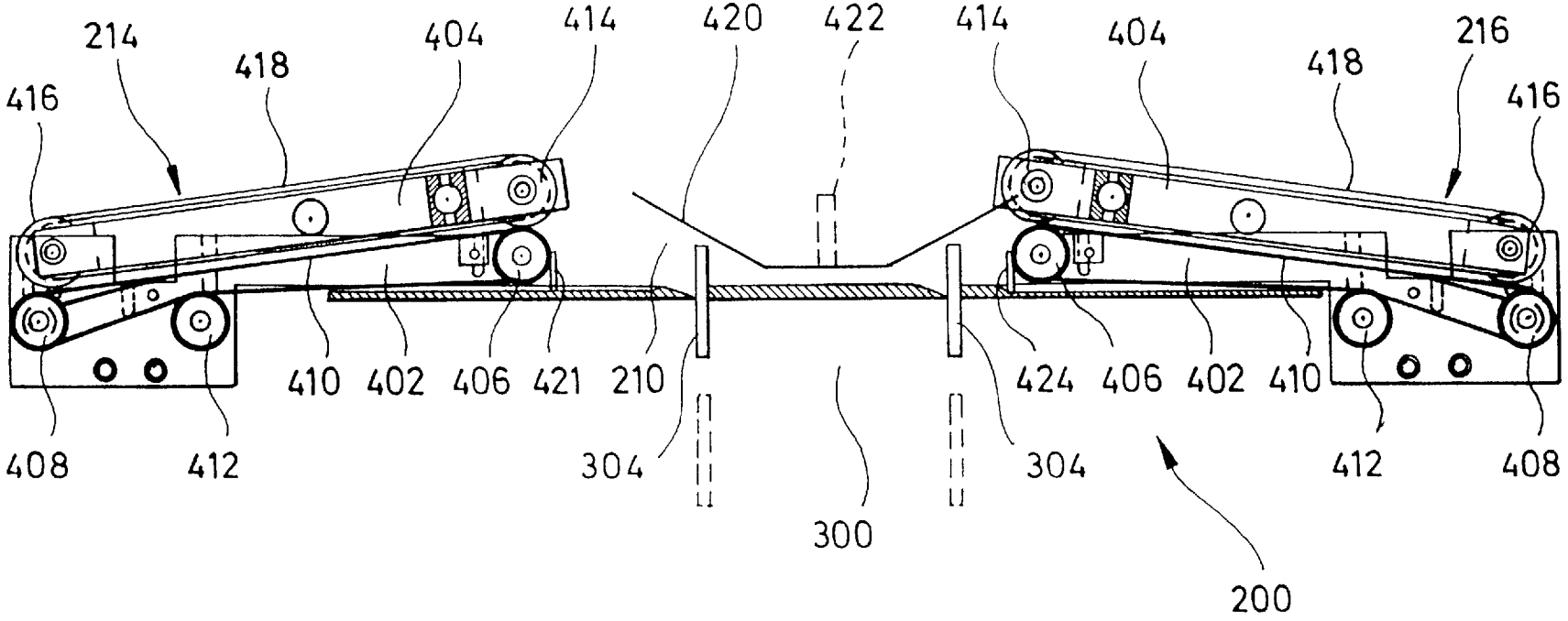
FIG. 4 shows a cross-sectional representation of the module shown in FIG. 2, at right angles to the direction of transport.

FIG. 4 shows a cross-sectional representation of the module 200, which is shown in FIG. 2, at right angles to the direction of transport and identical reference numerals have been used to designate identical elements.

The transfer bridges 214, 216, which are arranged at right angles to the direction of transport, each consist of a lower part 402 and an upper part 404. In view of the fact that the two transfer bridges have an identical structural design, only transfer bridge 214 will be described so as to simplify the description.

The lower part 402 comprises two drive and guide pulleys 406, 408, which guide and drive four individual belts 410 consisting here of flat belts. For additionally guiding the belts, a deflection pulley 412 is provided.

The upper part 404 of the transfer bridge 214 is passive, i.e. it is not driven, but it is caused to rotate together with the driven lower part 402. This part 404 comprises two pulleys 414, 416 for guiding a round-section belt 418. The paper is guided between the lower part 402 and the upper part 404.

In order to guarantee that the paper supplied reaches the collector box 210, an essentially V-shaped baffle plate 420, which is secured to a support member 422, is provided. Furthermore, limit stops 421 and 424 are provided at the edges of the collector box 210 so as to stop the paper supplied. A reliable introduction of the paper in the collector box will be achieved in this way.

After having described the structural design of module 200 on the basis of FIG. 2, 3 and 4, the mode of operation of said module 200 will be described hereinbelow.

In accordance with the preferred embodiment, said module 200 additionally comprises a signal processing means 230, which processes data concerning the paper to be handled. These data comprise e.g. information indicating which pieces of paper have to be supplied and where they have to be supplied, which kind of fold has to be produced by the paper folder 308, etc. The signal processing means detects these data from the module preceding it in the direction of transport and receives request signals from a module located after said signal processing means in the direction of transport for giving out the pieces of paper contained in the collector box.

Using the sensors 220, which detect whether a piece of paper/pieces of paper to be handled passed a predetermined position in the module, the signal processing means of said module 200 controls guidance of the paper into and out of the module 200.

In view of the fact that, according to the preferred embodiment, said module 200 includes a collector box 210 which is open at the front when seen in the direction of transport, the function of the finger provided in this embodiment is to stop paper, which is supplied in the direction of transport, in the collector box 210. When all pieces of paper have been introduced in the collector box 210 either in the direction of transport or transversely to the direction of transport, the signal processing means will recognize this by a comparison between the predetermined parameters stored therein and the detected sensor signals. If the signal processing means now receives a request signal from a module located after said module in the direction of transport, said signal processing means will prepare the discharge of the piece of paper/pieces of paper from the collector box 210. For this purpose, the circulating chain 302 is put in motion and, consequently, the fingers 304 will move in such a way that they run through the collector box 210 in the direction of transport; in so doing, they get hold of the paper and push it out of the collector box 210 in the direction of the paper folder 308, whereby the pieces of paper will leave the module 200 and be transferred to the next module or to a paper handling unit.

As has already been described in connection with FIG. 1, the signal processing means is additionally connected to a central computing unit (not shown) in accordance with the preferred embodiment, said central computing unit supervising the total operating sequence of the paper handling system.

Reference is made to the fact that the central computing unit does not carry out the total control of the individual modules, but that the individual modules 200 carry out the control themselves with the aid of the signal processing means and the data received by said signal processing means and concerning the pieces of paper to be handled.

Although not shown in FIG. 1, it is obvious that the supply of the pieces of paper transversely to the direction of transport in Sections A to E could also be effected from the side located opposite the cutters 114.

Furthermore, it will be obvious to the person skilled in the art that the cutters 114 used in FIG. 1 can also be replaced by other devices, such as a sheet applicator or a similar module.

It is obvious that the use of the modules 102 will essentially simplify the realization of predetermined requirements made by specific customers and the adaptation to given spatial circumstances because the gathering path can now be composed of a variable number of modules 102.

As can be seen from the rerouting means 116 following section E in FIG. 1, branching of the gathering path can easily be achieved by using the modules with an intermediate rerouting module.

The provision of a signal processing means in each of the modules simplifies the control insofar as the control is adjusted separately only for each module, without any necessity of effecting total control of the whole paper handling system.

To those skilled in the art, it will be obvious that the use of this modular gathering path will make the production process essentially less complicated, whereby the period of time required for production and, consequently, the time of delivery will be reduced substantially.

Furthermore, this system permits, due to the adaptable structural design of the gathering path, the construction of similar paper handling systems without any necessity of redesigning the paper gathering path.

What is claimed is:

1. A paper handling system, comprising:

a plurality of paper handling units; and a modular gathering path, said modular gathering path including a plurality of essentially corresponding modules, and each of said modules includes at least a collector box;

a transfer bridge for effecting supply in the direction of transport;

at least one transfer bridge for effecting supply in a direction transversely to the direction of transport; and a discharge unit.

2. A system according to claim 1, wherein said module additionally comprises a plurality of sensors for detecting whether a paper to be handled has passed a predetermined position in said module.

3. A system according to claim 1, wherein said module additionally comprises a signal processing means for processing data concerning the paper to be handled.

4. A system according to claim 3, wherein, in the direction of transport, said signal processing means receives and processes data concerning the treatment of the paper to be handled and that, in a direction opposite to the direction of transport, said signal processing means receives from a second module of said plurality of modules located after a first module of said plurality of modules in the direction of transport request signals for discharging the paper to be handled.

5. A system according to claim 3, wherein said module additionally comprises a plurality of sensors for detecting whether a paper to be handled has passed a predetermined position in said module, said sensors form light barriers, and wherein said signal processing means receiving sensor signals from said sensors and controlling, in response to said sensor signals received, the supply in the direction of transport, the supply transversely to the direction of transport, and the discharge of the paper to be handled.

6. A system according to claim 1, wherein said discharge unit comprises a circulating chain arrange below said collector box and having provided thereon at least one finger, which extends at right angles to a lower surface of said collector box and which pushes the paper out of said collector box while said chain is rotating.

7. A system according to claim 6, wherein said finger serves as a stopper in said collector box.

8. A system according to claim 1, wherein said module has a paper folder on an output side thereof, said paper fold being adapted to be adjusted for producing a Z-fold, a wound fold, a single fold or no fold at all.

9. A system according to claim 1, wherein the plurality of paper handling units comprises an imbrication means for arranging said pieces of paper such that one is placed below the other in overlapping relationship therewith, a rerouting module, a cutter, a sheet applicator, an imbrication belt, a controlled-output box, a first enveloping unit and a second enveloping unit.

10. A system according to claim 1, wherein each of said modules additionally comprise signal processing means for processing data concerning the paper to be handled, and wherein said paper handling system further includes a central computing unit, which is connected to each of said signal processing means for said modules and operates to supervises overall operating sequence of said paper handling system.

11. A paper handling system, comprising:

a plurality of paper handling units;

a modular gathering path, said modular gathering path including a plurality of structurally similar modules, and each of said modules includes at least a collector box, at least one transfer bridge for effecting supply in a predetermined direction, a plurality of sensors for detecting whether a paper to be handled has passed a predetermined position in said module, a discharge unit, and a module controller that controls operation of said module in conjunction with said transfer bridge, said sensors and said discharge unit; and a central computing unit, operatively connected to each of said module controllers for said modules and operates to supervises overall operating sequence of said paper handling system.

12. A system according to claim 11, wherein at least one of said paper handling units is an imbrication unit that arranges pieces of paper such that one is placed below the other in an overlapping relationship.

13. A system according to claim 12, wherein another one of said paper handling units is an enveloping unit.

14. A system according to claim 11, wherein, in a direction of transport, said module controller for a given one of said modules receives and processes data concerning the treatment of the paper to be handled and that the module controller for the given one of said modules receives transport request signals for discharging the paper to be handled from another one of said modules positioned in a direction opposite to the direction of transport.

15. A system according to claim 14, wherein at least one of said paper handling units is an imbrication unit that arranges pieces of paper such that one is placed below the other in an overlapping relationship.

16. A system according to claim 15, wherein another one of said paper handling units is an enveloping unit.

17. A system according to claim 11, wherein said discharge unit comprises a circulating chain arrange below said collector box and having provided thereon at least one finger, which extends at right angles to a lower surface of said collector box and which pushes the paper out of said collector box while said chain is rotating.

18. A system according to claim 17, wherein said finger serves as a stopper in said collector box.

19. A system according to claim 11, wherein said module has a paper folder on an output side thereof.

* * * * *